US007083121B2

(12) United States Patent
Huffman

(10) Patent No.: US 7,083,121 B2
(45) Date of Patent: Aug. 1, 2006

(54) MODULAR AUTOMATIC SPRAY GUN MANIFOLD

(75) Inventor: David C. Huffman, Merrimack, NH (US)

(73) Assignee: Spraying Systems Co., Wheaton, IL (US)

( * ) Notice: Subject to any disclaimer, the term of this patent is extended or adjusted under 35 U.S.C. 154(b) by 196 days.

(21) Appl. No.: 10/810,997

(22) Filed: Mar. 26, 2004

(65) Prior Publication Data

US 2005/0035225 A1 Feb. 17, 2005

Related U.S. Application Data

(60) Provisional application No. 60/457,946, filed on Mar. 27, 2003.

(51) Int. Cl.

| | |
|---|---|
| ***A62C 31/00*** | (2006.01) |
| ***B05B 7/10*** | (2006.01) |
| ***B05B 7/12*** | (2006.01) |
| ***B05B 7/06*** | (2006.01) |

(52) U.S. Cl. ..... 239/398; 239/401; 239/406; 239/407; 239/424.5; 239/551

(58) Field of Classification Search ..... 239/398, 239/401, 406, 407, 424.5, 548, 550, 551, 239/554, 566

See application file for complete search history.

(56) References Cited

U.S. PATENT DOCUMENTS 3,827,637 A * 8/1974 Stephany et al. ..... 239/242
4,257,559 A * 3/1981 Noren ..... 239/283
4,760,961 A * 8/1988 Nagai ..... 239/267
5,154,356 A * 10/1992 Sorenson ..... 239/550
5,740,970 A * 4/1998 Edwards ..... 239/551
5,862,987 A * 1/1999 Reif ..... 239/209

* cited by examiner

*Primary Examiner*—Davis Hwu
(74) *Attorney, Agent, or Firm*—Leydig, Voit & Mayer, Ltd.

(57) ABSTRACT

A modular automatic spray gun manifold is provided. The manifold includes a plurality of spray gun modules arranged in an array in laterally spaced relation from each other. A junction element is arranged at an upstream end of the manifold. The junction element includes a liquid supply connection and a pressurized air connection. A first support assembly is arranged between the junction element and a first spray gun module in the spray gun module array for supporting the first spray gun module relative to the junction element. The first support assembly includes a plurality of fluid conduits for supplying fluid to the first spray gun module. The fluid conduits in the first support assembly communicate with the liquid supply and pressurized air supply connections of the junction element. A second support assembly is arranged between each adjacent pair of spray gun modules in the array of spray gun modules for supporting the adjacent pair of spray gun modules relative to each other. Each second support assembly includes a plurality of fluid conduits for communicating fluid between the adjacent spray gun modules. One or more retaining elements secure the spray gun modules, support assemblies and junction plate in assembled relation.

19 Claims, 7 Drawing Sheets

MODULAR AUTOMATIC SPRAY GUN MANIFOLD

FIELD OF THE INVENTION

The present invention relates generally to spray gun type liquid spray devices, and more particularly, to an automatic spray gun manifold having a modular construction.

BACKGROUND OF THE INVENTION

Modular spray gun manifold assemblies that include a plurality of laterally spaced spray guns supported in a row for discharging an elongated spray pattern are known. Such manifolds are used, for example, in pill coating machines in the pharmaceutical industry. In these applications, the manifold must be movable between a predetermined operative position relative to a rotatable pill tumbler for applying the coating and a position in which the manifold is arranged away from the tumbler to facilitate cleaning.

Current manifold designs require a support structure to hold the spray guns in place. The size and weight of these manifold supports makes it difficult to mount the manifold in cantilever fashion, such as from a pivot door of a pill coating machine and to manipulate the manifold as may be required during use and/or cleaning. Moreover, current manifolds typically require a multiplicity of fluid supply lines that run along the support structure and communicate with each spray nozzle. This type of manifold not only requires extensive plumbing, but it is also difficult to clean, particularly to the extent required for use in pharmaceutical and food applications.

OBJECTS AND SUMMARY OF THE INVENTION

Accordingly, in view of the foregoing, an object of the present invention is to provide an improved lightweight spray gun manifold adapted for easier mounting and manipulation.

Another object is to provide a modular spray gun manifold as characterized above which eliminates the necessity for massive support members that significantly increase the weight of the manifold and impede easy movement of the manifold.

A further object is to provide a modular spray gun manifold of the above kind in which fluid directing conduits constitute the support structure of the manifold.

Still another object is to provide a modular spray gun manifold of the foregoing type that is adapted for easy disassembly for cleaning, or for enabling a change in the number of spray guns in the manifold.

Other objects and advantages of the invention will become apparent upon reading the following detailed description and upon reference to the drawings, in which:

DETAILED DESCRIPTION OF THE INVENTION

Figure 1:
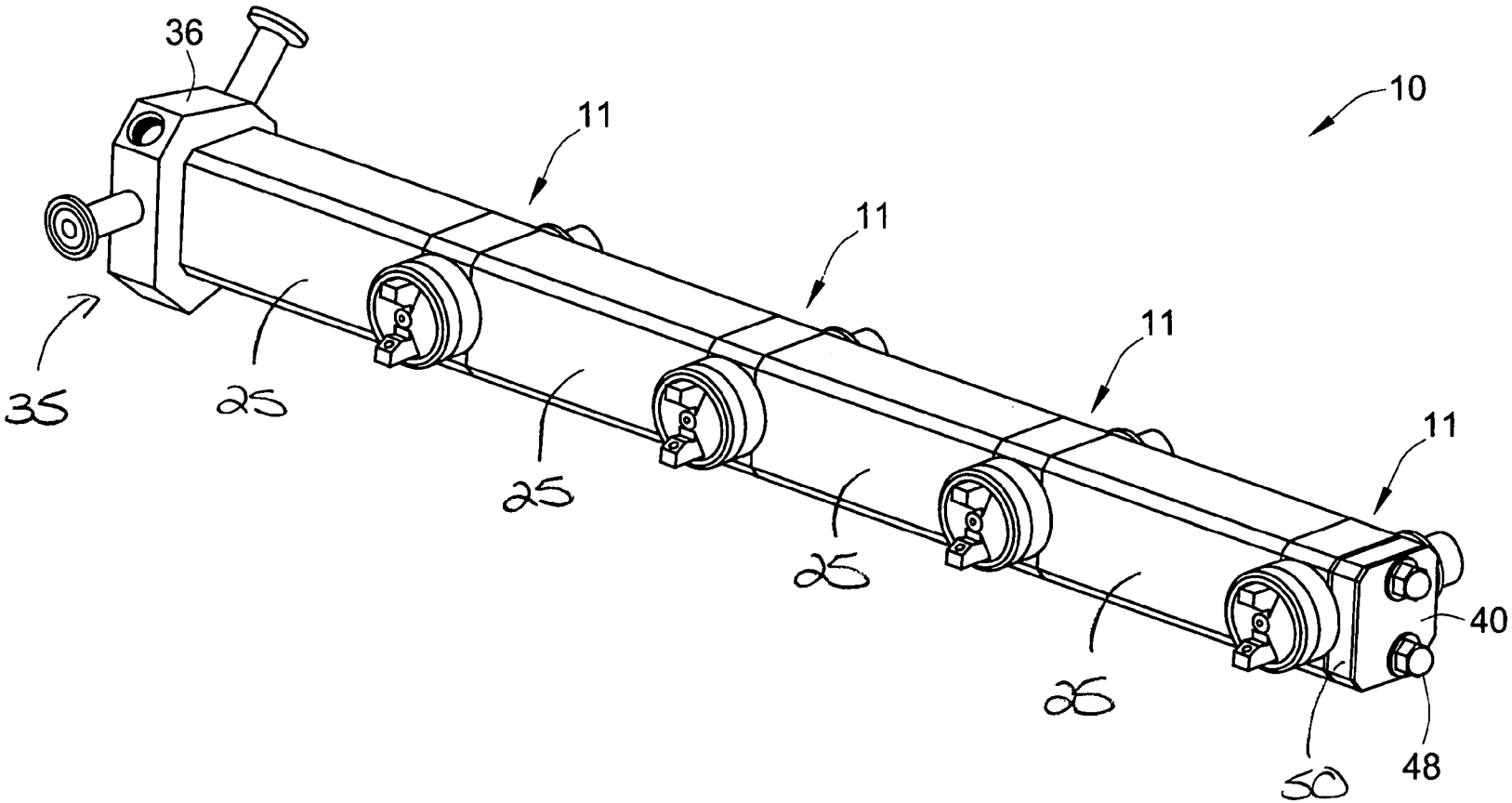
FIG. 1 is a perspective view of an exemplary modular spray gun manifold in accordance with the invention.

Referring now more particularly to FIG. 1 of the drawings, there is shown an illustrated modular spray gun manifold 10 in accordance with the invention. The manifold 10 includes a plurality of spray gun modules 11 each of which includes a rectangular block-shaped body 12, a spray nozzle assembly 13 supported at one end of the module body 12, and an actuator 14 supported at the opposite end of the module body 12. The basic structure and mode of operation of the spray gun modules are known in the art, for example, as shown in U.S. Pat. No. 5,707,010 assigned to the same assignee of the present application, the disclosure of which is incorporated herein by reference. The overall structure and mode of operation of the spray gun modules 11 should be understood to be illustrative of only one example of spray device with which the present invention may be used.

The spray nozzle assembly 13 of the illustrated spray gun module 11 is an external mix type of spray nozzle, namely a nozzle in which liquid and pressurized air or other gases are mixed externally of a liquid discharge orifice to produce a predetermined atomized spray pattern. The spray nozzle assembly 13 comprises a nozzle body and an air cap 18 releaseably mounted at the discharge end of the module body by a retaining ring 19, which in this case threadably engages the module body (see FIGS. 1 and 2). As is known in the art, "atomizing" air directed through the nozzle assembly interacts with and atomizes the discharging liquid and "fan air" directed through the air cap 18 further atomizes, forms and directs the discharging liquid spray. While an external mix type nozzle is illustrated, it will be understood that the present invention is not limited to any type of spray nozzle. For example, an internal mix type spray nozzle or any other suitable spray nozzle could be used.

The actuator 14, which also may be of a known type, has an end cap secured by a retaining ring that threadably engages an opposite end of the module body 12, and a valve needle with a piston that is selectively moved between valve on and off positions in a high speed cyclic mode through direction of pressurized air (i.e., control air) to the piston. While in the illustrated embodiment the spray nozzle assembly 13 and actuator 14 are individually mounted on and affixed to the module body 12, alternatively, the spray nozzle assembly and actuator may be part of a unitary removable cartridge, as disclosed in application Ser. No. 220,589 also assigned to the same assignee as the present application, the disclosure of which also is incorporated herein by reference. Of course, other types of actuators and spray nozzle assemblies could also be used and the present invention is not limited to any single type of actuator or spray nozzle.

Figure 2:
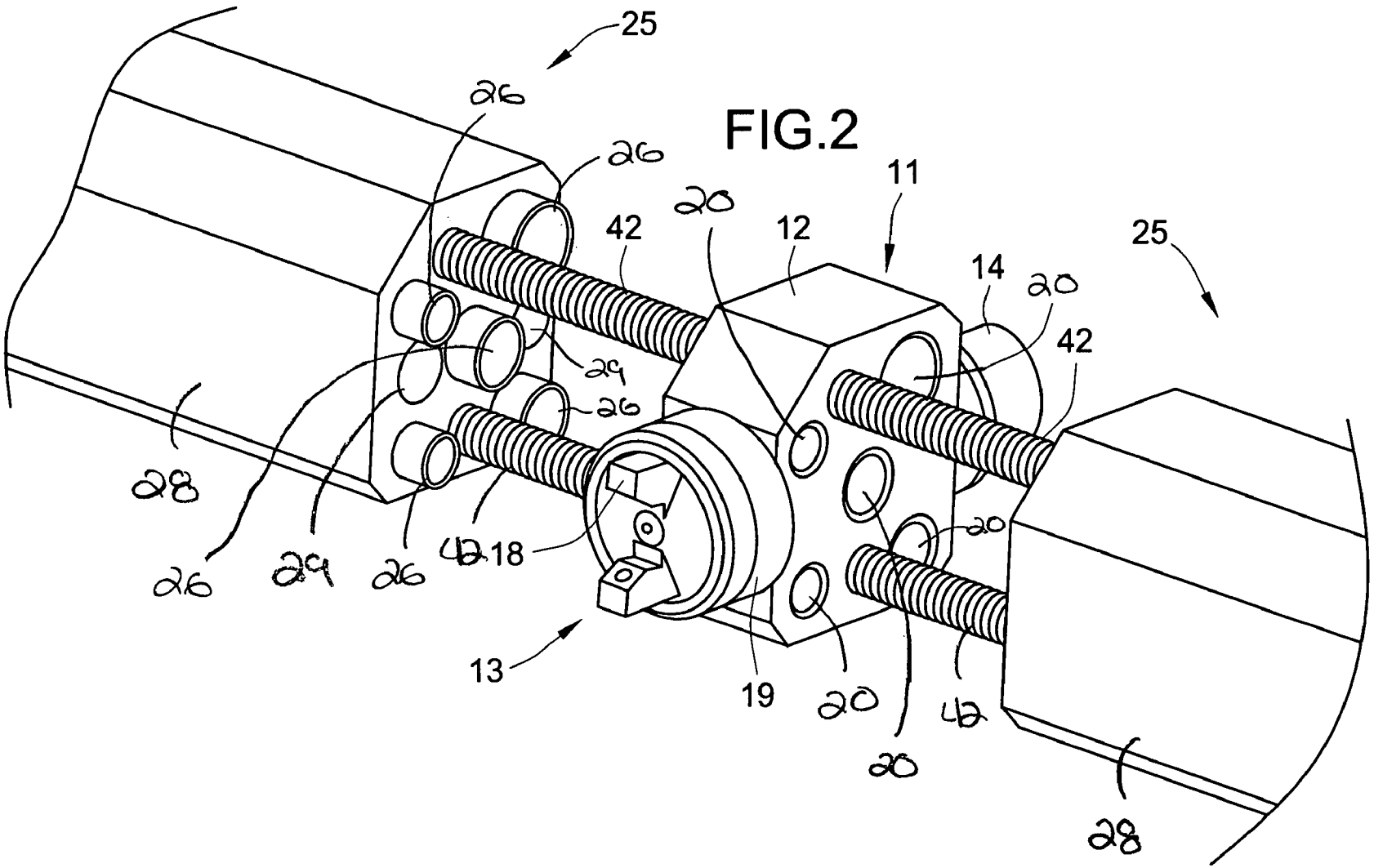
FIG. 2 is an enlarged, partially exploded perspective view of the modular spray gun manifold of FIG. 1 showing one of the spray gun modules and the adjacent supporting support assemblies.
Figure 5:
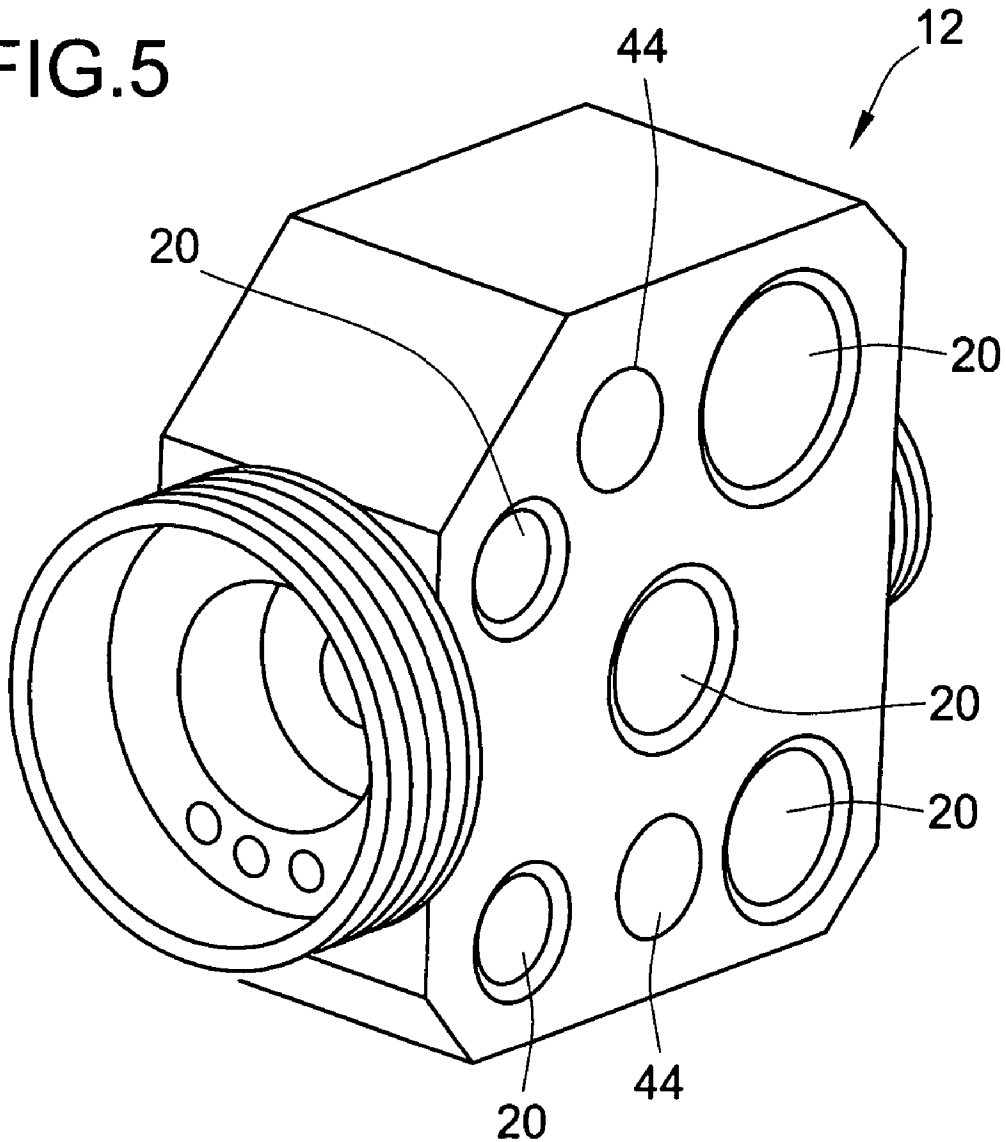
FIG. 5 is a perspective view of the body of one of the spray gun modules of the modular spray gun manifold of FIG. 1.

For permitting communication of liquid, atomizing air, fan air, and control air to the spray gun module 11, the module body 12 is formed with a plurality of respective fluid passages 20 extending transversely through opposite sides of the module body 12 that permit communication of fluids both to the spray nozzle assembly 13 and actuator 14 and through the module body 11 (see FIGS. 2 and 5). In this case, the module body 11 is also formed with a further return passage 20 for permitting recirculation of the liquid as explained in greater detail below.

In accordance with an important aspect of the invention, the manifold 10 has a lightweight, easy to manipulate and support construction with the spray gun modules 11 being connected and supported by the fluid communicating passages or conduits connecting the modules without the necessity for massive or heavy support plates or other structure. More particularly, the manifold 10 has a relatively lightweight construction that permits easy cantilever support of the manifold from a single end thereof and which can be easily disassembled for cleaning. In the illustrated embodiment, the spray gun modules 11 are interconnected in laterally spaced apart relation by fluid communication and support assemblies 25 interposed between adjacent spray gun modules 11 (see FIG. 1).

Figure 3:
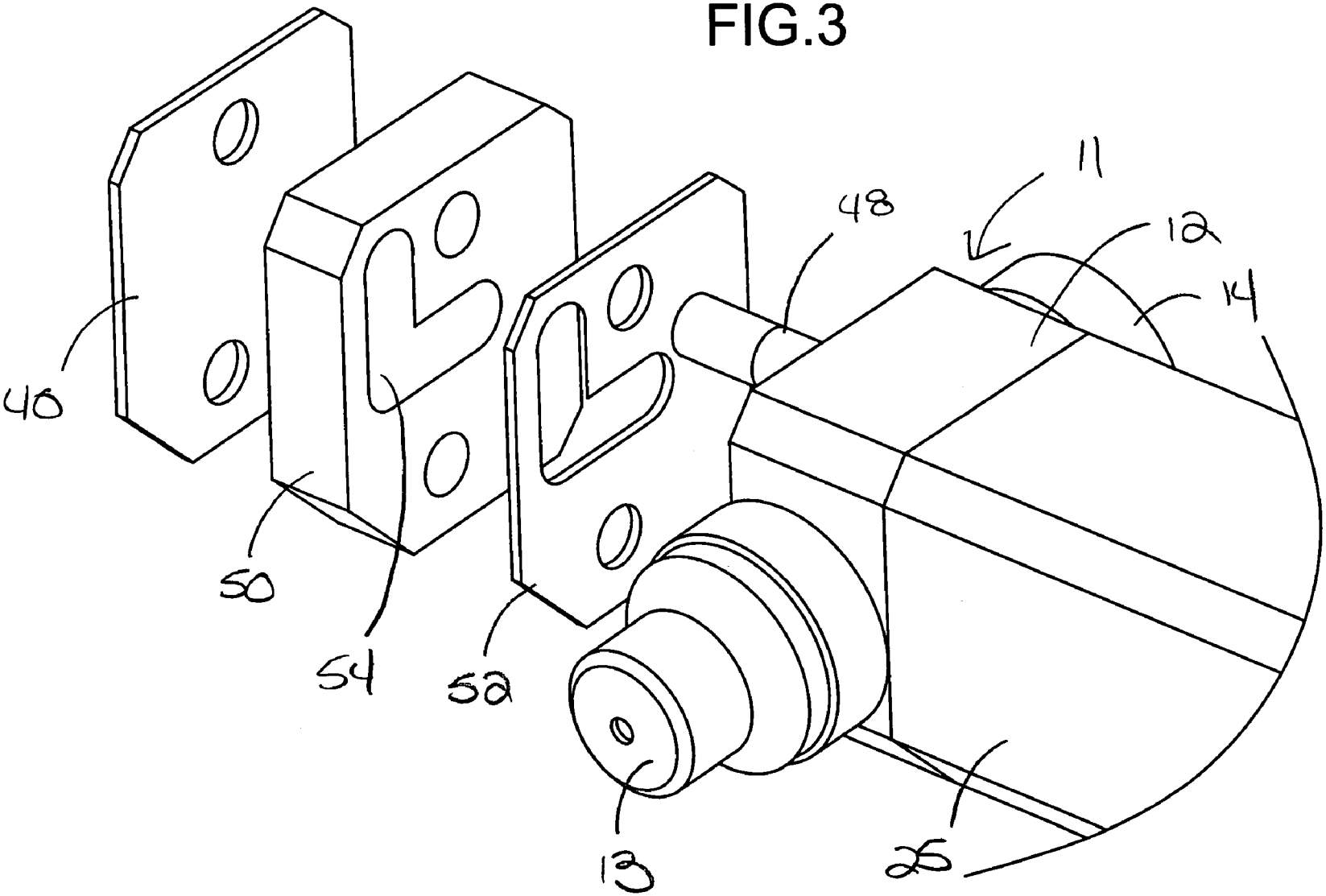
FIG. 3 is an enlarged, partially exploded perspective view of the modular spray gun manifold of FIG. 1 showing the end spray gun module and the adjacent fluid return plate.
Figure 4:
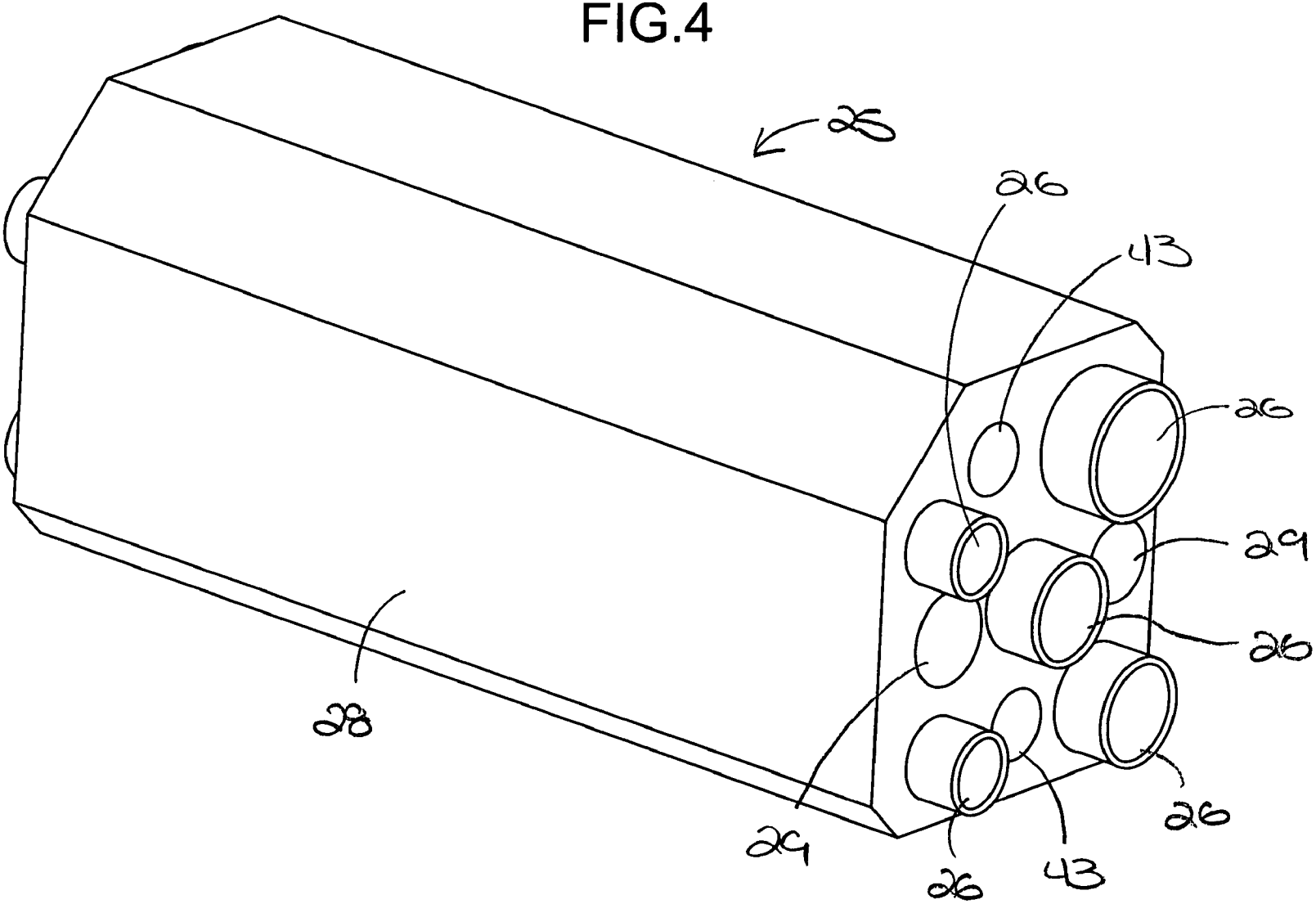
FIG. 4 is a perspective view of one of the supporting support assemblies of the modular spray gun manifold of FIG. 1.

The support assemblies 25 in this case include a plurality of fluid conduits 26 for supplying liquid, atomizing air, cylinder air, and control air to the passages 20 in the module bodies as shown in FIG. 4. In the embodiment illustrated in FIGS. 1–4, the support assemblies 25 comprise blocks 28 within which the fluid conduits 26 are embedded. Preferably, the blocks 28 are made of a relatively lightweight material such as Teflon® or the like. To further reduce the weight of the blocks, the illustrated support assemblies have a pair of additional passages 29 therethrough which are not necessarily used to direct fluid. The fluid conduits 26 each preferably extend outwardly a small distance beyond the respective ends of the blocks for insertion into the passages 20 with a threadless union therebetween (see, e.g., FIG. 2). Appropriate sealing members are provided about the fluid conduits 26.

Figure 6:
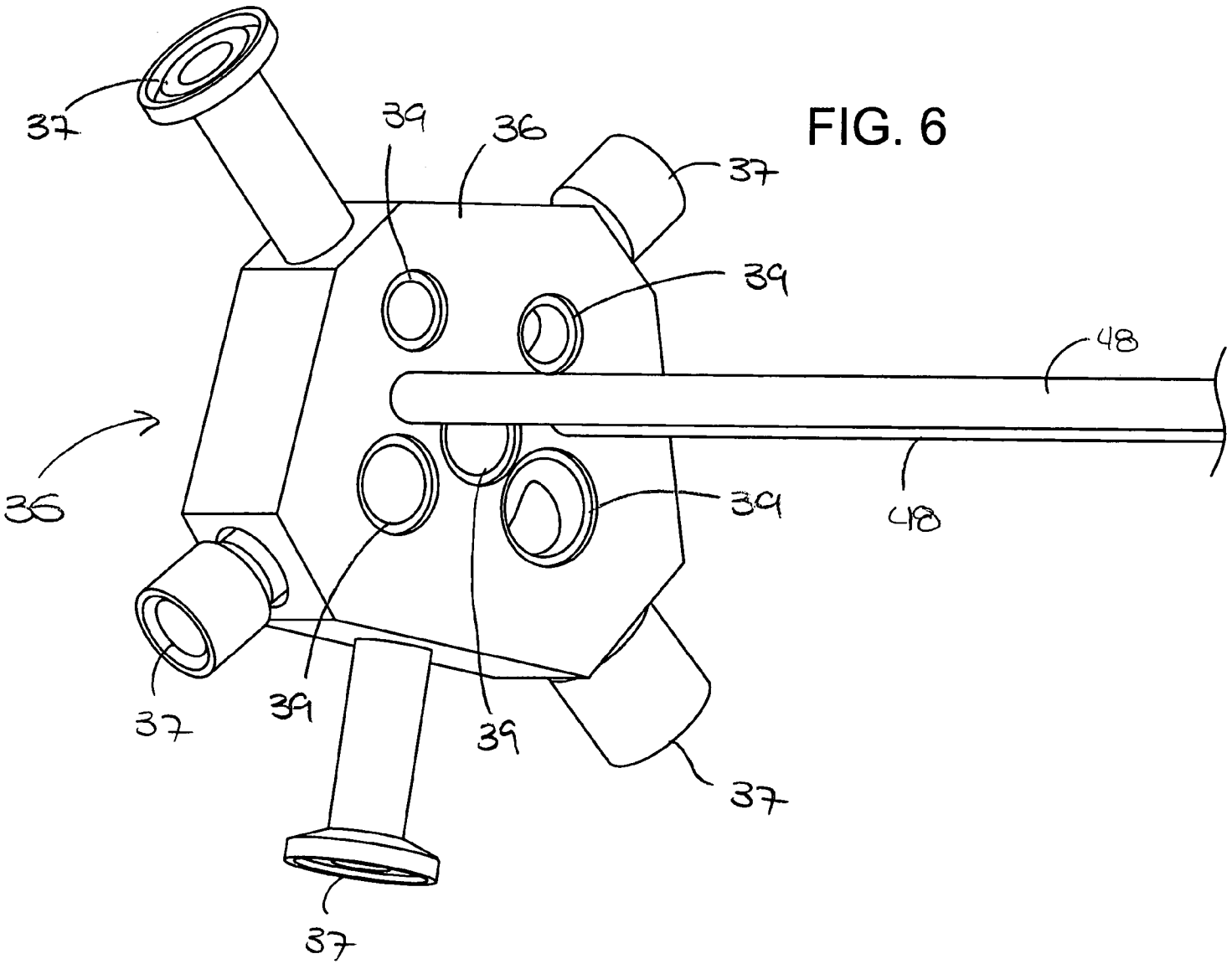
FIG. 6 is a perspective view of the junction plate of the modular spray gun manifold of FIG. 1.

In carrying out the invention, to permit communication of fluids to the support assemblies 25 and the interconnected spray gun modules 11 and to further enable cantilever support of the manifold 10, a support and junction plate 35 is mounted at an upstream end of the manifold 10. As shown in FIG. 6, the junction plate 35 in this case has an end plate portion 36 formed with a plurality of radial fluid connections 37 to which respective fluid supply lines can be connected at the end of the manifold. These connections 37 communicate with respective passages 39 that mate up with and communicate with the conduits 26 of the adjacent support assembly 25 when the manifold is assembled. For enabling cantilever support of the junction plate 35, an integrally formed mounting flange 38 (see FIG. 7) can extend in axial relation to the end plate portion 36 for coupling to a pivot door or other support structure.

As shown in FIG. 3, an end plate 40 in this case is mounted against and closes the end of the last spray gun module in the downstream direction. It will be understood that fluid communicated to the radial passageways 37 of the junction plate 35 will communicate through the support assemblies to and through each spray gun module 11. To permit recirculation of fluid back through the manifold 10, a fluid return plate 50 can be provided after the last spray gun module 11 before the end plate 40 as shown in FIG. 3. In this case, the fluid return plate 50 is separated from the last spray gun module 11 by a gasket 52. The fluid return plate 50 includes a slot 54 that communicates with two of the fluid passages 20 in the last spray gun module 11 thereby establishing a path by which fluid can move between the two passages. Thus, the slot allows fluid exiting one of the passages 20 to recirculate back into the other passage 20 and from there back through the manifold 10 in the upstream direction through respective recirculation passages 20 in the other spray gun modules 11 and corresponding recirculation conduits 26 in the support assemblies 25.

In further carrying out the invention, for releaseably securing the spray gun modules 11 of the manifold 10 in assembled relation to each other while permitting easy disassembly for cleaning and/or for addition or reduction in the number of spray gun modules 11, a pair of externally threaded retaining rods 42 are provided each of which extends the entire length of the manifold 10 and through the individual spray gun module bodies 12. In this case, each of the retaining rods 42 engage the junction plate 35 (see FIG. 6), extend through respective additional passages 43 of each support assembly 25 which house the rods (see, e.g., FIG. 4), through transverse passages 44 in the spray gun body 12 parallel to the fluid passages 20 (see FIG. 5), and through the end plate at the downstream end of the manifold (see FIG. 3). The passages 43 that house the retaining rods in this case do not protrude beyond the respective ends of the support assembly blocks. Wing nuts 48 are threaded onto the protruding ends of the retaining rods 42 to secure the spray gun modules 11 and support assemblies 25 in interposed relation between the retaining plate 40 and the junction plate 35 (see FIG. 1).

It will be seen that by removal of the wing nuts 48 and separation of the support assemblies 25 and spray gun modules 11 by reason of their threadless unions, the manifold 10 can be easily disassembled for cleaning. Likewise, the number of spray gun modules 11 can be easily modified simply by changing the number of spray gun modules 11 and support assemblies 25 and the length of the retaining rods 42.

Figure 7:
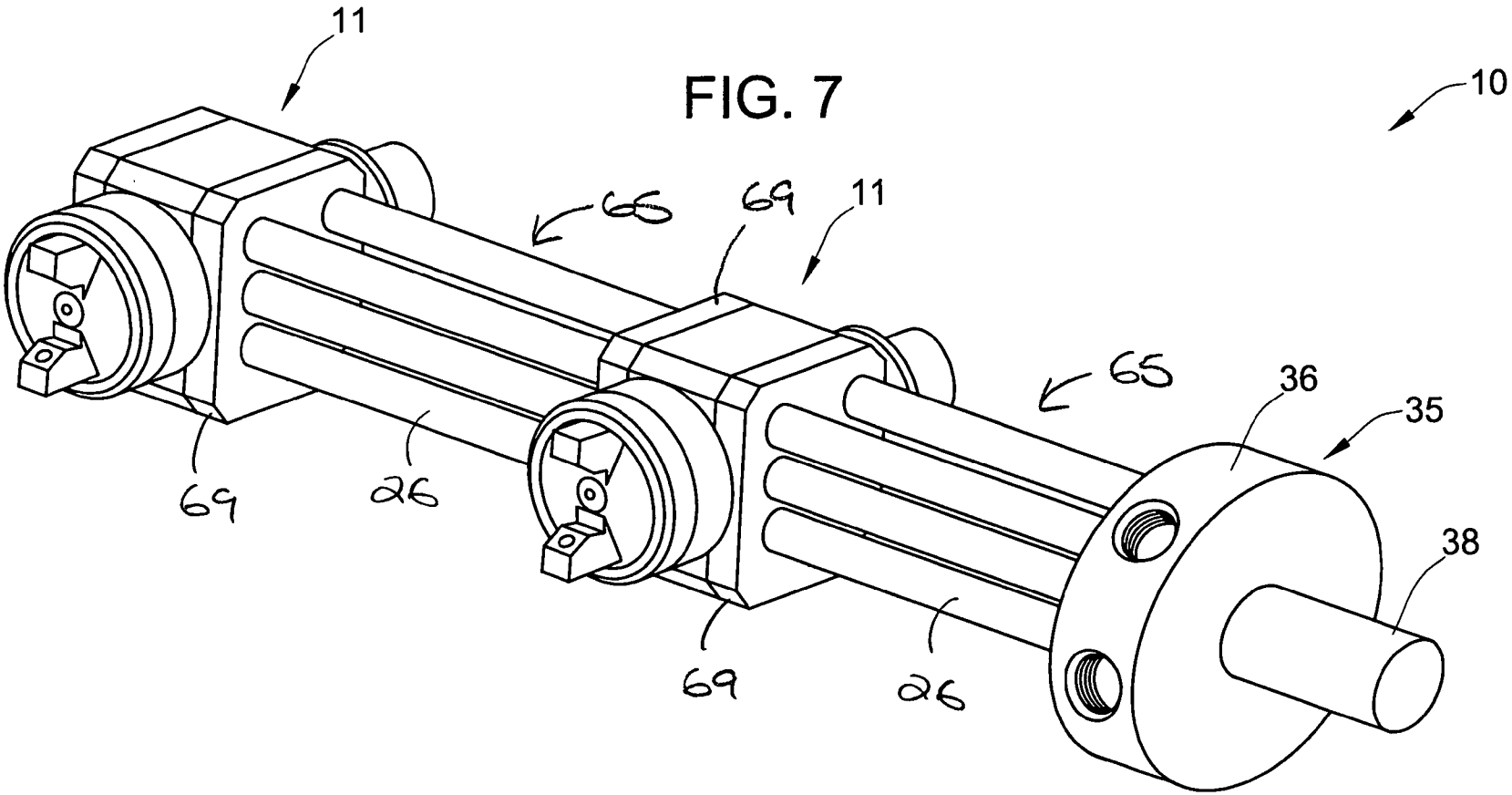
FIG. 7 is a perspective view of an alternative embodiment of a modular spray gun manifold according to the present invention.

A manifold 10 having an alternative embodiment of the support assemblies 65 is shown in FIG. 7. In the FIG. 7 embodiment, instead of a block configuration, the fluid conduits 26 associated with each of the support assemblies 65 are exposed. In the illustrated embodiment, the conduits 26 are supported relative to each other by lightweight end plates 69 are provided at opposite ends of the support assemblies 65. The junction plate 35 also has a slightly different configuration and includes a mounting flange 38.

From the foregoing, it can be seen that the modular spray gun manifold of the present invention has a lightweight construction which enables its support and manipulation without the necessity for massive support bars or other structures typical of the prior art. The manifold also has a relatively simple construction which lends itself to economical manufacture, efficient cleaning, and easy modification for particular spray applications.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A modular automatic spray gun manifold comprising:

a plurality of spray gun modules arranged in an array in laterally spaced relation from each other;

a plurality of support assemblies with one support assembly being arranged between each adjacent pair of spray gun modules for supporting the adjacent pair of spray gun modules relative to each other, each second support assembly including a plurality of fluid conduits for communicating fluid between the adjacent spray gun modules; and one or more retaining elements extending through the spray gun modules and the support assemblies for securing the spray gun modules and support assemblies in assembled relation.

2. The spray gun manifold according to claim 1 wherein each spray gun module includes an external mix type spray nozzle and wherein one of the plurality of fluid conduits in each of the support assemblies communicates atomizing air to the spray gun modules.

3. The spray gun manifold according to claim 2 wherein the spray nozzle of each spray gun module includes an air cap and wherein one of the plurality of fluid conduits in each of the support assemblies communicates fan air to the respective air caps of the spray gun modules.

4. The spray gun manifold according to claim 1 wherein each spray gun module includes an actuator and wherein one of the plurality of fluid conduits in each of the support assemblies communicates control air to the respective actuators of the spray gun modules.

5. The spray gun manifold according to claim 1 wherein the plurality of fluid conduits of each support assembly are embedded in a block element.

6. The spray gun manifold according to claim 5 wherein each fluid conduit of each support assembly extends outwardly a distance beyond respective ends of the block element for insertion into corresponding passages in the spray gun modules with a threadless union therebetween.

7. The spray gun manifold according to claim 1 wherein the plurality of fluid conduits of each support assembly extend between end plates provided at opposite ends of the respective support assembly.

8. The spray gun manifold according to claim 1 further including a junction element arranged at an upstream end of the manifold that includes a liquid supply connection and a pressurized air supply connection.

9. The spray gun manifold according to claim 1 wherein one of the plurality of fluid conduits in each of the support assemblies is for recirculating fluid and further including a fluid return plate at a downstream end of the manifold that defines a fluid path permitting recirculation of fluid through the spray gun modules and the recirculating fluid conduits of the support assemblies in an upstream direction.

10. The spray gun manifold according to claim 1 wherein the one or more retaining elements comprises a retaining rod extending through each of the spray gun modules and each of the support assemblies.

11. The spray gun manifold according to claim 1 wherein the one or more retaining elements comprises a retaining rod that engages the junction element and extends through each of the support assemblies and the spray gun modules.

12. A modular automatic spray gun manifold comprising:

a plurality of spray gun modules arranged in an array in laterally spaced relation from each other;

a junction element arranged at an upstream end of the manifold, the junction element including a liquid supply connection and a pressurized air connection;

a first support assembly arranged between the junction element and a first spray gun module in the spray gun module array for supporting the first spray gun module relative to the junction element, the first support assembly including a plurality of fluid conduits for supplying fluid to the first spray gun module, the fluid conduits in the first support assembly communicating with the liquid supply and pressurized air supply connections of the junction element;

one or more second support assemblies with one second support assembly being arranged between each adjacent pair of spray gun modules in the array of spray gun modules for supporting the adjacent pair of spray gun modules relative to each other, each second support assembly including a plurality of fluid conduits for communicating fluid between the adjacent spray gun modules such that fluid introduced into the manifold through the liquid supply and pressurized air supply connection of the junction element is communicated to and through each spray gun module; and one or more retaining elements for securing the spray gun modules, support assemblies and junction plate in assembled relation.

13. The spray gun manifold according to claim 12 wherein each spray gun module includes an external mix type spray nozzle and wherein one of the plurality of fluid conduits in each of the support assemblies communicates atomizing air to the spray gun modules.

14. The spray gun manifold according to claim 13 wherein the spray nozzle of each spray gun module includes an air cap and wherein one of the plurality of fluid conduits in each of the support assemblies communicates fan air to the respective air caps of the spray gun modules.

15. The spray gun manifold according to claim 12 wherein each spray gun module includes an actuator and wherein one of the plurality of fluid conduits in each of the support assemblies communicates control air to the respective actuators of the spray gun modules.

16. The spray gun manifold according to claim 12 wherein the plurality of fluid conduits of each support assembly are embedded in a block element.

17. The spray gun manifold according to claim 14 wherein each fluid conduit of each support assembly extends outwardly a distance beyond respective ends of the block element for insertion into corresponding passages in the spray gun modules with a threadless union therebetween.

18. The spray gun manifold according to claim 12 wherein the plurality of fluid conduits of each support assembly extend between end plates provided at opposite ends of the respective support assembly.

19. The spray gun manifold according to claim 12 wherein one of the plurality of fluid conduits in each of the support assemblies is for recirculating fluid and further including a fluid return plate at a downstream end of the manifold that defines a fluid path permitting recirculation of fluid through the spray gun modules and the recirculating fluid conduits of the support assemblies in the upstream direction.

* * * * *